US010065105B2

(12) United States Patent
Frost

(10) Patent No.: US 10,065,105 B2
(45) Date of Patent: Sep. 4, 2018

(54) LOTTERY TICKET APPARATUS CONTAINING MULTIPLE GAME PLAY AREAS AND METHODS THEREOF

(71) Applicant: Cathy S. Frost, Los Angeles, CA (US)

(72) Inventor: Cathy S. Frost, Los Angeles, CA (US)

(73) Assignee: FROST PRODUCTIONS, LLC, Los Angeles, CA (US)

( * ) Notice: Subject to any disclaimer, the term of this patent is extended or adjusted under 35 U.S.C. 154(b) by 1 day.

(21) Appl. No.: 14/824,812

(22) Filed: Aug. 12, 2015

(65) Prior Publication Data

US 2016/0038826 A1 Feb. 11, 2016

Related U.S. Application Data

(63) Continuation of application No. 14/199,134, filed on Mar. 6, 2014, which is a continuation of application No. 13/051,710, filed on Mar. 18, 2011.

(60) Provisional application No. 61/315,688, filed on Mar. 19, 2010.

(51) Int. Cl.

| | |
|---|---|
| ***B42D 15/00*** | (2006.01) |
| ***B42D 15/10*** | (2006.01) |
| ***A63B 71/00*** | (2006.01) |
| ***A63F 1/00*** | (2006.01) |
| ***A63F 1/18*** | (2006.01) |
| ***A63F 3/06*** | (2006.01) |
| ***B41M 3/00*** | (2006.01) |
| ***G07C 15/00*** | (2006.01) |

(52) U.S. Cl.

CPC ..... *A63F 3/0665* (2013.01); *A63F 3/0655* (2013.01); *B41M 3/005* (2013.01); *G07C 15/005* (2013.01)

(58) Field of Classification Search

CPC ... A63F 3/0665; A63F 3/0655; G07C 15/005; B41M 3/005

USPC ..... 283/72, 94, 98, 100, 101, 901, 903; 273/138.1, 139, 269

See application file for complete search history.

(56) References Cited

U.S. PATENT DOCUMENTS

| | | | | |
|---|---|---|---|---|
| 6,224,055 B1 * | 5/2001 | Walker | ..... | A63F 3/0665 273/139 |
| 2007/0187888 A1 * | 8/2007 | Dures | ..... | A63F 3/0665 273/138.1 |

* cited by examiner

*Primary Examiner* — Justin V Lewis

(74) *Attorney, Agent, or Firm* — Patzik, Frank & Samotny Ltd.

(57) ABSTRACT

A scratch off lottery ticket and method of manufacturing the scratch off lottery ticket in which the lottery ticket contains multiple game play areas where a player can scratch off a layer of scratch off material to reveal the hidden results, and depending on those results, can be awarded prizes for each particular game play area or can be awarded prizes for the combination of the results from two or more of the multiple game play areas.

10 Claims, 2 Drawing Sheets

LOTTERY TICKET APPARATUS CONTAINING MULTIPLE GAME PLAY AREAS AND METHODS THEREOF

PRIORITY STATEMENT

This application claims the benefit of U.S. Provisional Application 61/315,688 filed Mar. 19, 2010.

FIELD OF THE INVENTION

The present invention relates to novel lottery tickets and methods and, in particular, to novel lottery tickets and methods of manufacture for instant, scratch off lottery ticket games in which a lottery ticket contains multiple game play areas where a player can scratch off a layer of scratch off material to reveal the hidden results. Depending on those results; the player can be awarded prizes for each particular game play area or can be awarded prizes for the combination of the results from two or more of the multiple game play areas.

By scratching off or removing the scratch off material, usually a latex based layer, the player can determine if that particular lottery ticket has revealed a winning combination of similar prizes or symbols in the single game play area, or if two or more game play areas have combined to result in a winning combination of similar prizes or symbols across the multiple game play areas.

The multiple game play areas are indicated on top of the scratch off layer when the lottery ticket is purchased and will be displayed below the scratch off layer, after the scratch off layer is removed in attempting to match prize amounts or symbols and thus win one or more prizes and possible bonus or multipliers of the prize amount.

BACKGROUND OF THE INVENTION

Lotteries are a form of gambling in which, at its simplest form, is based on drawing lots to determine a winner of a prize. There are numerous types of lotteries, including sweepstakes, in which the prize can be a fixed amount of cash or goods. The chance of winning this type of lottery is dependent on the number of players; the more players that purchase a lottery ticket, the less chance each player has to win the lottery. This format however, creates a risk to the organizer since if insufficient tickets are sold, not enough money will be raised to pay the cash or goods prize.

More commonly, the lottery prize will be a fixed percentage of the receipts from the purchase of the tickets, such as a 50% draw where the players are promised a prize of 50% of the revenue of the ticket sales. Again, the chance of winning the lottery is based on the number of players.

More recent lotteries, such as the multistate Power Ball and Mega Millions lotteries, allow purchasers to select the numbers on the lottery ticket, resulting in the possibility of multiple winners. The chance of winning these types of lotteries is dependent on the odds of picking the correct numbers that match those selected at the time of the drawing. However, there are so many numbers to select from that the chance of winning (or having multiple winners) is extremely low. Further, these lotteries will split the winnings between any players that pick the correct numbers. Regardless, even if the winners have to split the prize money, due to the low odds (and usually low purchase price) millions of players purchase these tickets and these types of lotteries generate millions and often tens or hundreds of millions of dollars for a single winner.

Another type of lottery ticket is known as the scratch off lottery cards or lottery tickets. These tickets are also known as scratch cards, scratch off tickets or instant tickets. The scratch off tickets usually contain a layout of prize amounts or symbols that, if displayed in a certain combination or in a certain number of similar amounts, are considered a winning ticket. The prize is determined by the prize amount listed in the winning combination or based on the symbols (and the particular rules of the game).

The scratch off tickets contain an opaque layer on top of the ticket results, so that the player cannot see the results until after they purchase the ticket and scratch off the top opaque layer. The scratch off layer is usually made from a latex material and can be scratched off with a fingernail, the end of a coin or some other object.

Scratch off lottery tickets have a different appeal than the sweepstakes type lottery games since a player can purchase the scratch off ticket and play instantaneously, and not wait for the sweepstakes drawing. These types of tickets provide instant gratification (if the player purchases a winning ticket). The manufacture or printing process for the tickets utilize various algorithms to emulate random play, different play styles and rules accompany the different types of scratch off tickets and the different prize amounts. Further, the scratch off tickets vary in size depending on the game play and price, but generally the tickets can be as small as two by four, and as large as four by eight.

These scratch off lottery tickets are a more recent development in the history of gaming, and while lotteries have been prominent throughout the world for hundreds of years or longer, scratch cards were invented in 1974, by John Koza and Daniel Bower.

Immediately, scratch cards became very popular games due to their ease and simplicity, and state lotteries found the scratch off games to be a complementary product to their main lottery business. Along with the larger paying lotteries, players could play these instant scratch off games and obtain immediate results.

One of the first scratch off lottery tickets, called The Instant Game, was launched by the state of Massachusetts in the mid 1970s. Many national and state lotteries caught on quickly and began to offer scratch off games. In 1987, Astro-Med, Inc. obtained U.S. Pat. No. 4,643,454 for an instant lottery ticket with a coating on the front side.

The Michigan Lottery became very active in scratch off instant games, giving lotto players a wide range of scratch cards to choose from with a price range from one dollar to twenty dollars. The United States became the leader in the popularity of scratch cards and in the quantity of instant games tickets sold. In around 1985, scratch off lottery tickets came to Europe, and as in the United States, became very popular. In the 1990s, the popularity of instant gratification of the scratch off lottery ticket came to the Internet.

There is currently no lottery ticket to mutually satisfy the player with multiple game play areas on a single lottery ticket card that incorporates the game play for each of the multiple game play areas as well as incorporating a game play for at least two of the game play areas for winning possibilities. There is also no method for manufacturing a scratch off lottery ticket with multiple game play areas on a single lottery ticket card that incorporates the game play for each of the multiple game play areas as well as incorporating a game play for at least two of the game play areas for winning possibilities.

SUMMARY OF THE INVENTION

The present invention is directed to a novel lottery ticket game play for scratch off lottery ticket games. The lottery ticket contains multiple game areas in which a player can scratch off the opaque layer to reveal the game results. The lottery ticket is a winner if any of the particular game areas reveal a winning combination of prize amounts or symbols, or if two or more game areas can be combined to create a winning combination of prize amounts or symbols.

As such and as a non-limiting example, if the scratch off lottery ticket contains four game play areas, each made up of a three-by-three tic-tac-toe layout, and the four game areas are set up as a two-by-two matrix, then the lottery ticket is a winner if any of the game areas, when the opaque area is removed, display three similar prize amounts or symbols in a row, column or diagonal. As such, each game area has eight possibilities for a winning combination (three across, three up and down and two diagonals). Thus, the four area lottery ticket has 32 possible winning combinations.

Also, the multiple game play areas can be combined into a single game play area in which depending on the rules, the player can scratch off the scratch off layer and reveal different combinations of similar prize amounts or symbols across at least two of the game play areas and be awarded prizes for the combination. As an example, if each of the six diagonal spaces (from two of four game play areas) starting in the upper left of the entire lottery ticket game play area to the lower right of the game play area contain the same prize amount or symbols, the player will be awarded a prize in addition to winning the two diagonals from the separate game play areas. The prize may be a bonus multiplier that the prize awarded from each of the two game areas will be multiplied by for the total prize award.

The same rules can be applied to any of the six spaces for the remaining diagonal, the six space rows or six space columns created by putting the four game areas together, or even a larger prize if the lottery ticket reveals both diagonals (an X) across the four game play areas. Other winning combinations can be used for the different game play areas, such as revealing similar prize amounts or symbols in each of the positions that make up the outer "box" of the entire game play area, and other designs as well.

These and other aspects, features, and advantages of the present invention will become more readily apparent from the attached drawings and the detailed description of the preferred embodiments, which follow.

DESCRIPTION OF THE DRAWINGS

The preferred embodiments of the invention will be described in conjunction with the appended drawings provided to illustrate and not to the limit the invention, where like designations denote like elements, and in which.

DETAILED DESCRIPTION OF THE PREFERRED EMBODIMENTS

Figure 1:
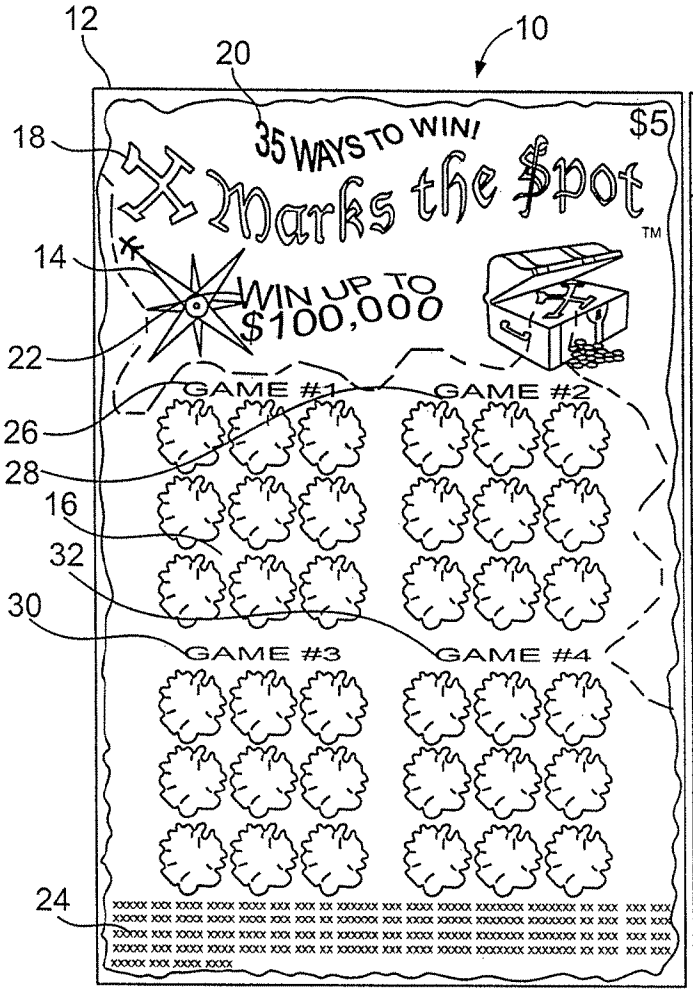
FIG. 1 is a front view of a first embodiment of the lottery ticket in accordance with the present invention.

FIG. 1 illustrates a lottery ticket 10 in accordance with the preferred embodiment of the present invention. The lottery ticket 10 is made up of a cardboard base 12 with fanciful printing 14 on the cardboard base 12 and an opaque layer 16 that can be scratched off without damaging the underlying information (not shown in FIG. 1). The opaque layer 16 is usually made from a latex material and can be scratched off using the end of a coin or a fingernail.

The fanciful printing 14 can include the title 18 of the lottery ticket 10, in this case "X Marks the Spot", the number of possible winning combinations 20, the maximum amount the player can win 22, and instructions for playing the game 24. Additional printing can be included for decoration or informational purposes.

The lottery ticket 10 can range in size anywhere from two inches by four inches, up to four inches by eight inches, although the size of the lottery ticket 10 does not matter and smaller or larger lottery tickets 10 can be used and still come within the scope of the invention.

In the preferred embodiment shown in FIG. 1, there are four separate areas or regions in which game play can take place separately from the other areas or in combination with one or more of the other areas. The four areas displayed include Game #1 26, Game #2 28, Game #3 30, and Game #4 32. Each of the separate game areas 26, 28, 30, 32 comprise a three row by three column array, making up nine different positions in each game area 26, 28, 30, 32. These game areas 26, 28, 30, 32 are covered by the opaque material 16 and therefore cover or hide the prize amount or symbols that must be uncovered to play the game.

Figure 2:
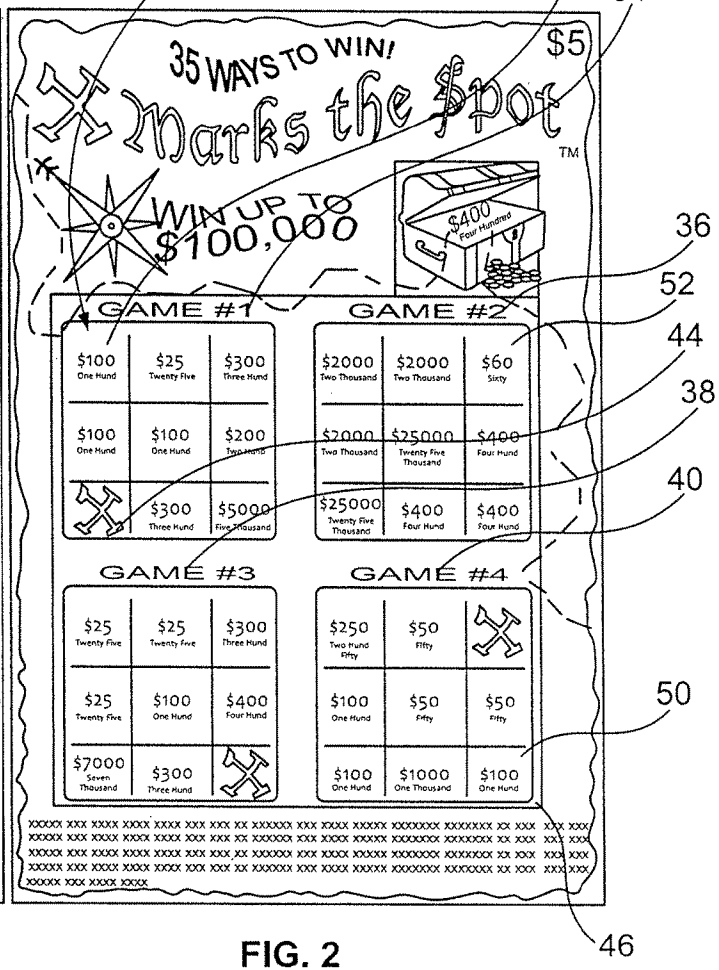
FIG. 2 is a front view of a first embodiment of the lottery ticket with the scratch off material removed in accordance with the present invention.

To play the game, the player purchases the lottery ticket 10 shown in FIG. 1 and scratches off the opaque material 16 covering each of the game areas 26, 28, 30, 32. The resulting figure (in this example) is shown in FIG. 2. As shown, much of the fanciful printing 14 remains on the surface of the lottery ticket 10, including the title 18, the number of possible winning combinations 20, the maximum amount the player can win 22, and instructions for playing the game 24.

However, the scratching off of the four game play areas 26, 28, 30, 32 uncovers the four game play area results; Game #1 34, Game #2 36, Game #3 38, and Game #4 40. the results for each game play area determines whether or not that particular game is a winner. For example, the results in Game #1 34 indicate that the player has won $100 based on the results displayed in the first column 42, which contains two similar prize amounts of $100 and a symbol X 44 that is wild in this game, and can be used as any result (here, $100).

Once all of the positions for the four games 34, 36, 38, 40 in this example have been revealed, there may be other combinations of similar prize amounts or symbols that provide the player with a winning combination. For example, if the six positions forming a diagonal 46 from the upper left 48 of the entire game play area down to and including the lower right position 50 of the entire game play area, contained a similar prize amount or symbol (or if the game play provides for wild symbols, a combination of similar prize amounts or symbols and a wild symbol), then the player would win the individual game plays for Game #1 34 and Game #4 40, and also win another prize amount (in addition, as a multiplier or a different amount altogether) for having the successful combination of similar prize amounts or symbols in the positions for the entire diagonal 46.

Further, the multiple game play (as opposed to the separate individual game play) can have a number of different designs or winning combinations based on the positions of the similar prize amounts or symbols. For example, each off the four games 34, 36, 38, 40 can be used to create two intersecting diagonals 46, 52, using six positions each, to make a large X in the middle of the entire game play.

Additional game plays can incorporate a winning combination of all twenty positions on the perimeter of the entire game play area; a large box. In another embodiment, the winning combination can be a grid of four Xs from each of the four games 34, 36, 38, 40, such that the entire game play area has a checkerboard pattern. In yet another embodiment, any of the six positions across or up and down the entire game play area can be both a winning combination in the two individual game play areas, and in the entire game play area. Other winning designs and combinations can be incorporated within the scope of the invention.

The scope of the invention is not limited to a three by three array and other arrays can be utilized to obtain the same results. For example, a five by five array can be used with four separate games or with nine individual games set up as a three by three array of individual games.

Further, the scope is not limited to a particular prize amount or a particular bonus or multiplier if the multiple game play results in a favorable combination. Other amounts can be used both for the individual game play and the multiple game play.

Figure 3:
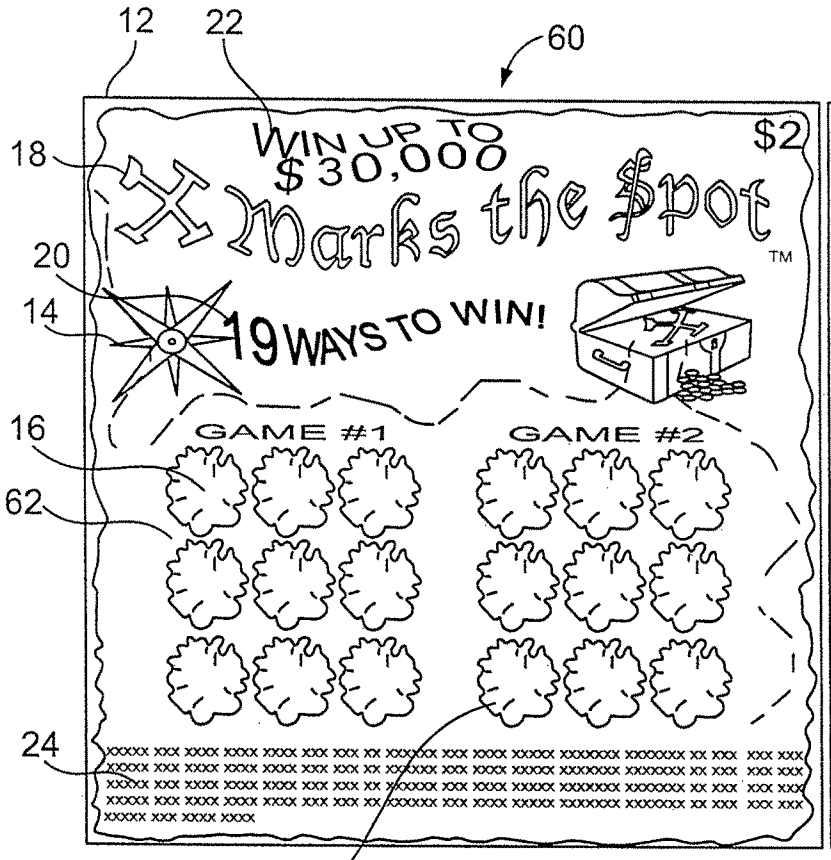
FIG. 3 is a front view of a second embodiment of the lottery ticket in accordance with the present invention.

FIG. 3 shows another lottery ticket game play 60 that incorporates two individual game play areas 62, 64. As described above, the lottery ticket 60 is made up of a cardboard base 12 with fanciful printing 14 on the cardboard base 12 and an opaque layer 16 that can be scratched off using the end of a coin or a fingernail. The fanciful printing 14 may include one or more of the title 18, the number of possible winning combinations 20, the maximum amount the player can win 22, and instructions for playing the game 24, among other things. Additional printing can be included for decoration or informational purposes.

Figure 4:
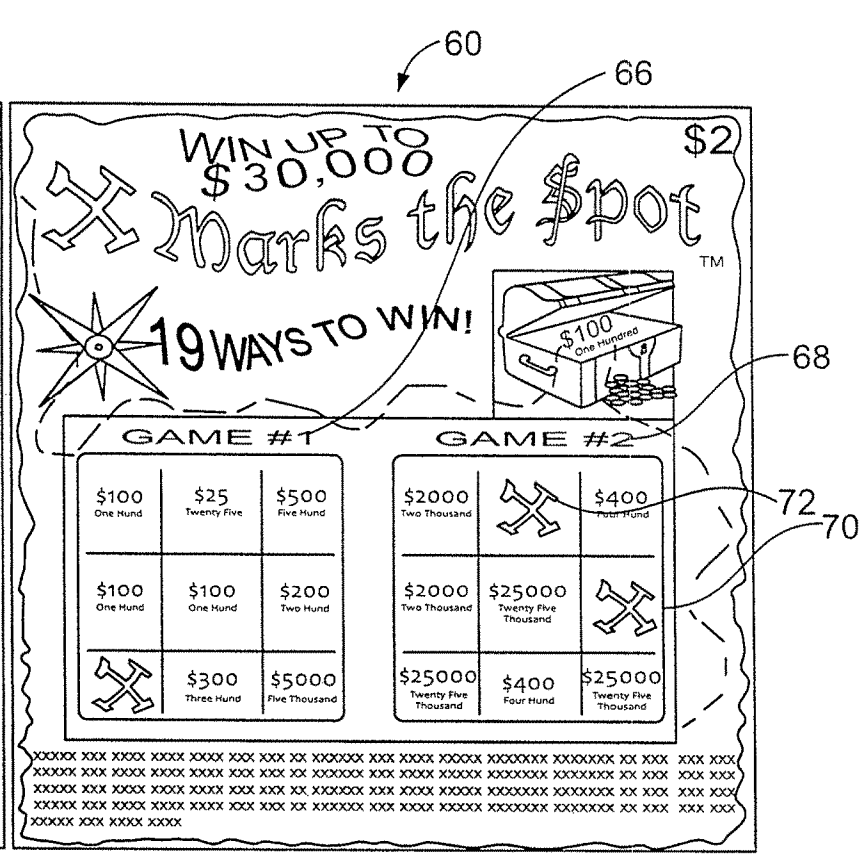
FIG. 4 is a front view of a second embodiment of the lottery ticket with the scratch off material removed in accordance with the present invention.

FIG. 4 shows the lottery ticket 60 after the scratch off material has been removed and the game play results for Game #1 66 and Game #2 68 have been revealed. In this example, since there are only two games, there is no way to place similar prize amounts or symbols across a diagonal as done previously. However, other designs as discussed herein and that are based on the two game play set up can be utilized for winning combinations.

For example, a row of similar prize amounts or symbols can be revealed across the six positions 70 in row two (not shown here as a winning combination). As such, the player can will in both individual game plays 66, 68 and also receive the bonus amount or multiplier for the successful combination in the six positions from row 270. Other designs can be incorporated, including a checkerboard pattern or a box pattern as described above.

Further, the rules may allow for a winning combination if, between the two different games 66, 68, removing the scratch off material reveals a particular number of a unique symbol 72 (in this case, an X). In this example, the two games 66, 68 revealed three Xs 72, which may be a winning combination. This game play can be incorporated in any of the game play described herein.

To manufacture the lottery tickets 10, 60 described herein, including those lottery tickets that come within the scope of the present invention, the manufacture uses one or both sides of a cardboard base 12 and may print decorations or information about the lottery ticket, that may include one or more of the title 18, the number of possible winning combinations 20, the amount the player can win 22, and instructions for playing the game 24, among other things. Additional printing can be included for decoration or informational purposes.

The manufacturer also prints on at least a portion of one side, a number of prize amounts or symbols in various positions. These positions are combined or separated to create two or more game play areas that may be shown as a design before scratching off the scratch off layer, but will be revealed as separate game play (and the entire game play) when the player scratches off the scratch off material.

Further, by strategically placing the prize amounts or symbols (including wild symbols), only a certain number of the lottery tickets will contain winning combinations. As understood by those having ordinary skill in the art, numerous lottery tickets are printed, with a small percentage having winning combinations and usually an even smaller percentage having winning combinations of larger prize amounts.

The various game play areas of the lottery ticket are then covered with the scratch off material 16. In doing so, the multiple prize amounts or symbols are concealed from the player before purchasing the lottery ticket.

Also, the game play instructions may be printed on one or both sides of the lottery ticket. These instructions explain to the player the rules of the game play, and that the player must scratch off the scratch off layer to reveal the prize amounts or symbols to determine if a there is a winning combination on that particular card.

Instructions may also be printed on either of the two sides of the lottery ticket that describe the combinations of similar prize amounts or symbols that must be revealed in order for the lottery ticket to contain a winning combination. The instructions including a description of winning combinations of similar prize amounts or symbols for each of the individual games and a description of winning combinations of similar prize amounts or symbols for the combination of the entire game (or at least two of the game play areas).

The described embodiments are to be considered in all respects only as illustrative and not restrictive, and the scope of the invention is, therefore, indicated by the appended claims rather than by the foregoing description. Those of skill in the art will recognize changes, substitutions and other modifications that will nonetheless come within the scope of the invention and range of the claims.

The invention claimed is:

1. A scratch off lottery ticket apparatus comprising a first side and a second side, said first side comprising a plurality of symbols, said plurality of symbols positioned to create only four individual game play areas, each of said four individual game play areas comprising a three-by-three array of symbols, said four individual game play areas positioned to create an entire game play area comprising a two-by-two array of the four individual game play areas, said first side further comprising an opaque scratch off material layer, such that said plurality of symbols cannot be determined through the scratch off material layer, whereby upon removing all of the scratch off material layer, each of the four individual game play areas reveals winning combination of identical symbols in the four individual game play areas, and whereby upon removing all of the scratch off material layer, said entire game play area of said four three-by-three arrays of symbols reveals a second winning combination of identical symbols, wherein said second winning combination utilizes at least one symbol from the plurality of symbols from each of the four individual game play areas to create said second winning combination in the entire game play area, said second winning combination of identical symbols further comprises a diagonal from the upper left symbol of the two-by-two array of the four individual game play areas to the lower right symbol of the two-by-two array of the four individual game play areas, and wherein said second winning combination of identical symbols further comprises a diagonal from the upper right symbol of the two-by-two array of the four individual game play areas to the lower left symbol of the two-by-two array of the four individual game play areas, such that said second winning combination comprises twelve identical symbols, thereby generating an X pattern across the four individual game play areas.

2. The scratch off lottery ticket apparatus of claim 1, wherein said plurality of symbols includes at least one wild symbol, which will have the value of the identical symbols.

3. The scratch off lottery ticket apparatus of claim 1, wherein said plurality of symbols is 36 symbols.

4. The scratch off lottery ticket apparatus of claim 1, wherein said first winning combination in each of the four individual game play areas comprises identical symbols on a diagonal of the three-by-three array.

5. A method for printing a scratch off lottery ticket apparatus having a first side and a second side, with a scratch off layer on said first side and exactly four three-by-three array individual game play areas creating an entire game play area comprising a two-by-two array of the four individual game play areas, and each of said four three-by-three array individual game play areas comprising a plurality of symbols in which each of the four three-by-three array individual game play areas may reveal a first winning combination of said plurality of symbols and the four three-by-three array individual game play areas must be combined to reveal a second winning combination of said plurality of symbols, the method comprising the steps of:

a) printing on at least a portion of the first side of a scratch off lottery ticket apparatus a plurality of symbols, said plurality of symbols being positioned to create four three-by-three array individual game play areas and an entire game play area made up of said four three-by-three array individual game play areas, said entire game play area comprising a two-by-two array of the four individual game play areas;

b) covering said four three-by-three array individual game play areas with a scratch off material, such that said one or more of the plurality of symbols are not revealed without removing said scratch off material;

c) printing instructions on either of said two sides, said instructions instructing a player to remove the scratch off material from the four three-by-three array individual game play areas to reveal said plurality of symbols for each of the four three-by-three array individual game play areas and for the entire game play area;

d) whereby upon removing all of the scratch off material layer, each of the four three-by-three array individual game play areas reveals a first winning combination of identical symbols in the four individual game play areas, and whereby upon removing all of the scratch off material layer, said entire game play area reveals a second winning combination of identical symbols, wherein said second winning combination must utilize at least one symbol from each of the four three-by-three array individual game play areas, said second winning combination of identical symbols further comprises a diagonal from the upper left symbol of the two-by-two array of the four individual game play areas to the lower right symbol of the two-by-two array of the four individual game play areas, and wherein said second winning combination of identical symbols further comprises a diagonal from the upper right symbol of the two-by-two array of the four individual game play areas to the lower left symbol of the two-by-two array of the four individual game play areas, such that said second winning combination comprises twelve identical symbols, thereby generating an X pattern across the four individual game play areas.

6. The method for printing a scratch off lottery ticket apparatus of claim 5, further comprising the step of:

(e) printing instructions on either of said two sides, said instructions including a description of winning combinations of identical symbols, said winning combinations including a description of winning combinations of identical symbols for each of said four three-by-three array individual game play areas, and a description of winning combinations of identical symbols for said entire game play area.

7. The method for printing a scratch off lottery ticket apparatus of claim 5, wherein said plurality of symbols includes at least one wild symbol.

8. The method for printing a scratch off lottery ticket apparatus of claim 5, wherein said plurality of symbols is 36 symbols.

9. The method for printing a scratch off lottery ticket apparatus of claim 5, wherein said first winning combination in each of the four individual game play areas comprises similar symbols on a diagonal of the three-by-three array.

10. The method for printing a scratch off lottery ticket apparatus of claim 9 wherein said second winning combination of symbols is a first diagonal of similar symbols and a second diagonal of similar symbols, said first diagonal of similar symbols located across two of the four individual game play areas and said second diagonal of similar symbols located across the remaining two of the four individual game play areas.

* * * * *